US009506132B2

(12) United States Patent
Katsumura et al.

(10) Patent No.: US 9,506,132 B2
(45) Date of Patent: Nov. 29, 2016

(54) METHOD FOR MANUFACTURING HEAVY WALL STEEL PIPE

(71) Applicant: JFE STEEL CORPORATION, Tokyo (JP)

(72) Inventors: Tatsuro Katsumura, Tokyo (JP); Hiroyuki Fukuda, Tokyo (JP); Koji Sugano, Tokyo (JP); Kazutoshi Ishikawa, Tokyo (JP); Yasuhide Ishiguro, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/433,727

(22) PCT Filed: Oct. 3, 2013

(86) PCT No.: PCT/JP2013/005900

§ 371 (c)(1),
(2) Date: Apr. 6, 2015

(87) PCT Pub. No.: WO2014/054287

PCT Pub. Date: Apr. 10, 2014

(65) Prior Publication Data

US 2015/0247227 A1 Sep. 3, 2015

(30) Foreign Application Priority Data

Oct. 4, 2012 (JP) ..... 2012-221875

(51) Int. Cl.
*C22C 38/54* (2006.01)
*C21D 9/08* (2006.01)
(Continued)

(52) U.S. Cl.
CPC ..... *C22C 38/54* (2013.01); *C21D 1/00* (2013.01); *C21D 1/18* (2013.01); *C21D 1/60* (2013.01); *C21D 6/001* (2013.01); *C21D 6/004* (2013.01); *C21D 6/005* (2013.01); *C21D 6/008* (2013.01);
(Continued)

(58) Field of Classification Search
CPC ..... C21D 1/63; C21D 1/64; C21D 9/085; C21D 9/0018
See application file for complete search history.

(56) References Cited

U.S. PATENT DOCUMENTS

2013/0160903 A1* 6/2013 Seo ..... C21D 1/63 148/590

FOREIGN PATENT DOCUMENTS

JP 54-169105 11/1979
JP 58-052427 A 3/1983
(Continued)

OTHER PUBLICATIONS

Feb. 16, 2016 Search Report issued in European Application No. 13844288.4.
(Continued)

*Primary Examiner* — Rebecca Lee
(74) *Attorney, Agent, or Firm* — Oliff PLC

(57) ABSTRACT

A method for manufacturing a heavy wall steel pipe includes a cooling step in which a steel pipe, with a wall thickness of ½ inch or more, that has been heated to the gamma range is dipped in water while supporting and rotating the steel pipe about the axis of pipe, an axial stream which is a water flow in the direction of axis of pipe is applied to the inside surface of the steel pipe under rotation in the water, and an impinging stream which is a water flow impinging on the outer surface of the pipe is applied to the outer surface of the steel pipe under rotation in the water.

8 Claims, 1 Drawing Sheet

(51) Int. Cl.

| | |
|---|---|
| ***C21D 1/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 8/10*** | (2006.01) |
| ***C21D 1/60*** | (2006.01) |
| ***C21D 1/18*** | (2006.01) |
| ***C21D 6/00*** | (2006.01) |

(52) U.S. Cl.

CPC ..... *C21D 8/105* (2013.01); *C21D 9/08* (2013.01); *C21D 9/085* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01)

(56) References Cited

FOREIGN PATENT DOCUMENTS

| | | | | | |
|---|---|---|---|---|---|
| JP | 58-141332 | A | | 8/1983 | |
| JP | 59-076822 | A | | 5/1984 | |
| JP | 60-125327 | A | | 7/1985 | |
| JP | 05-065541 | A | | 3/1993 | |
| JP | 07-090378 | A | | 4/1995 | |
| JP | 07090378 | A | * | 4/1995 | |
| JP | 2008-231487 | A | | 10/2008 | |
| JP | 2011-246798 | A | | 12/2011 | |
| JP | WO 2012029268 | A1 | * | 3/2012 | ..... C21D 1/63 |

OTHER PUBLICATIONS

Murata et al., Both side dip quenching of steel pipes, Tetsu-to-Hagane (Iron and Steel), '82-S1226 (562), Aug. 20, 1982.

Dec. 17, 2013 International Search Report issued in PCT/JP2013/005900.

* cited by examiner

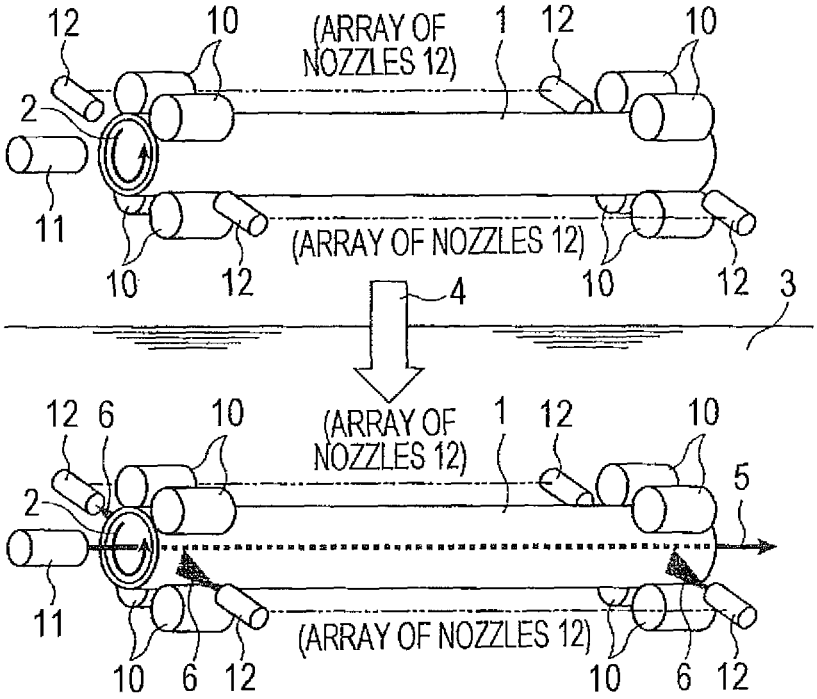
12
10
(ARRAY OF NOZZLES 12)
1
12
10
2
11
10
12
(ARRAY OF NOZZLES 12)
10
12
4
3
12
6
10
(ARRAY OF NOZZLES 12)
1
12
10
5
2
11
10
6
12
(ARRAY OF NOZZLES 12)
10
6
12

METHOD FOR MANUFACTURING HEAVY WALL STEEL PIPE

TECHNICAL FIELD

This application is directed to a method for manufacturing a heavy wall steel pipe or steel tube. More particularly, this application relates to a method for manufacturing a heavy wall steel pipe in which the strength of a heavy wall steel pipe having a wall thickness of ½ inch (=12.7 mm) or more can be adjusted by heat treatment, in particular, by one quenching and tempering (Q-T) operation, to a target strength of 95 to 140 ksi (=TS: 655 to 965 MPa).

BACKGROUND

Some of the known steel pipe quenching techniques are as follows:

1) Both sides dip quenching of steel pipes in which steel pipe rotation is added to multiple constraint including pipe ends is markedly effective in preventing quench distortion, and also improves cooling capacity. Therefore, this technique is suitable for heat treatment (Q-T) of seamless steel pipes and electric resistance welded steel pipes, in particular, heavy wall steel pipes (refer to Non Patent Literature 1).

2) In a both sides and axial stream dip quenching method, a heated steel pipe is dipped in a water tank, and quenching is performed while applying a cooling water flow (axial stream) to both sides of the steel pipe along the direction of axis. This method is advantageous in that its cooling capacity is large, and the structure of the equipment is simple (refer to paragraph [0002] of Patent Literature 1).

3) In rotary quenching equipment for steel pipes, in order to minimize the difference in cooling history in the circumferential direction of pipe, a steel pipe is dipped in water in a water tank while rotating the steel pipe, and water injected from nozzles in the water is sprayed to both sides of the steel pipe to perform quenching. This equipment is placed in a final heat treatment line for carbon steel pipes (refer to paragraphs [0002] to [0003] of Patent Literature 2).

On the other hand, as the thin-walled (wall thickness: less than 1 inch) steel pipe whose strength can be stably adjusted to the target strength by Q-T, a steel pipe is known which has a composition (hereinafter referred to as the "composition A1") containing, in percent by mass, 0.15% to 0.50% of C, 0.1% to 1.0% of Si, 0.3% to 1.0% of Mn, 0.015% of less of P, 0.005% or less of S, 0.01% to 0.1% of Al, 0.01% or less of N, 0.1% to 1.7% of Cr, 0.40% to 1.1% of Mo, 0.01% to 0.12% of V, 0.01% to 0.08% of Nb, 0.0005% to 0.003% of B, and further optionally one or two or more of 1.0% or less of Cu, 1.0% or less of Ni, 0.03% or less of Ti, 2.0% or less of W, and 0.001% to 0.005% of Ca, the balance being Fe and incidental impurities (refer to Patent Literature 3).

CITATION LIST

Patent Literature

PTL 1: Japanese Unexamined Patent Application Publication No. 7-90378

PTL 2: Japanese Unexamined Patent Application Publication No. 2008-231487

PTL 3: Japanese Unexamined Patent Application Publication No. 2011-246798

Non Patent Literature

NPL 1: Murata at al., Both side dip quenching of steel pipes; Tetsu-to-Hagane (Iron and Steel), '82-S1226 (562)

SUMMARY

Technical Problem

However, according to the background art described above, in the case where the steel pipe having the composition A disclosed in Patent Literature 3 is formed into the heavy wall steel pipe, it is difficult to stably adjust the strength to the target strength (to a surface hardness/center hardness ratio of 1.00 to 1.05) by one Q-T operation. Accordingly, in such a case, conventionally, a quenching (Q) operation is repeated a plurality of times and/or the amount of an alloy that contributes to improvement in quench hardenability to be added in the composition A is increased. However, in the former measure, heat treatment costs increase, which is disadvantageous. In the latter measure, since weldability and corrosion resistance (in particular, hydrogen sulfide corrosion resistance) are impaired, there is a limit, and alloy costs increase, all of which are disadvantageous. Therefore, the background art has the problem that it is difficult to stably adjust the strength of the heavy wall steel pipe to the target strength (to a surface hardness/center hardness ratio of 1.00 to 1.05) by one Q-T operation.

Solution to Problem

The present inventors have performed thorough studies in order to solve the problem described above. As a result, it has been found that, by employing a specific cooling condition in a cooling step in which a high-temperature steel pipe is dipped in water while supporting and rotating the steel pipe about the axis of pipe, and a water flow is applied to each of the inside and outer surfaces of the steel pipe under continued rotation, the cooling capacity is improved, quenching is sufficiently performed to the central portion in the wall thickness direction even in a heavy wall steel pipe having the composition A, and the strength of the steel pipe can be stably adjusted to the target strength (to a surface hardness/center hardness ratio of 1.00 to 1.05) by one Q-T operation. Thereby, disclosed embodiments have been achieved.

That is, this disclosure provides a method for manufacturing a heavy wall steel pipe including a cooling step in which a steel pipe, with a wall thickness of ½ inch or more, that has been heated to the gamma range (i.e., austenite region) is dipped in water while supporting and rotating the steel pipe about the axis of pipe, an axial stream which is a water flow in the direction of axis of pipe is applied to the inside surface of the steel pipe under rotation in the water, and an impinging stream which is a water flow impinging on the outer surface of the pipe is applied to the outer surface of the steel pipe under rotation in the water. The method is characterized in that the rotation is performed at a circumferential velocity of pipe of 4 m/s or more, the application of the axial stream and the impinging stream is started within 1.1 s after the entire steel pipe is dipped, and continued until the temperature of the steel pipe is decreased to 150° C. or lower, the pipe flow velocity of the axial stream is set at 7 m/s or more, and the discharge flow velocity of the impinging stream is set at 9 m/s or more.

Advantageous Effects

According to embodiments, during quenching, the cooling capacity in terms of the heat-transfer coefficient at the inside and outer surfaces of the steel pipe improves to a range of 7,500 to 8,000 kcal/m$^2$·h·° C., quenching is sufficiently performed to the central portion in the wall thickness direction even in a heavy wall steel pipe having the composition A, and the strength of the steel pipe can be stably adjusted to the target strength by one Q-T operation.

BRIEF DESCRIPTION OF THE DRAWINGS

FIG. 1 is a schematic view showing an example of a cooling step according to an embodiment.

DETAILED DESCRIPTION

As shown in FIG. 1, in the cooling step according to embodiments, in order to perform quenching, a steel pipe 1, with a wall thickness of ½ inch or more (preferably, 2 inch or less), that has been heated to the gamma range (i.e., austenite region) is dipped 4 in water 3 (cooling medium) while supporting and rotating 2 the steel pipe 1 about the axis of pipe, an axial stream 5 which is a water flow in the direction of axis of pipe is applied to the inside surface of the steel pipe 1 under rotation 2 in the water 3, and an impinging stream 6 which is a water flow impinging on the outer surface of the pipe is applied to the outer surface of the steel pipe 1 under rotation 2 in the water 3. In this example, a support and rotary means for the steel pipe 1 supports the steel pipe 1 by bringing a plurality of (at least two) rollers 10 having a rotation axis parallel to the axis of pipe into contact with the periphery of the pipe at a plurality of (at least two) points in the direction of axis of the steel pipe 1. The steel pipe 1 is rotated 2 by driving any (at least one) of the plurality of rollers 10 into rotation. The plurality of rollers 10 are supported and elevated by a support and elevating means (not shown) so that they can move in and out of the water 3. In this case, the temperature of the water 3 is preferably 50° C. or lower.

Furthermore, in this example, the axial stream 5 is applied by water injection from a nozzle 11 arranged at one end side in the direction of axis of the steel pipe 1. On the other hand, the impinging stream 6 is applied by water injection from a plurality of nozzles 12 arrayed in the direction of axis of pipe at both sides in the pipe diameter direction of the steel pipe 1 that is perpendicular to the direction of axis of the steel pipe 1. The nozzles 11 and 12 are, as in the case of the plurality of rollers 10, supported and elevated by the support and elevating means (not shown) so that they can move in and out of the water 3.

In the cooling step, in the rotation 2, the circumferential velocity of pipe VR is set to be equal to or more than the critical value VCR (=4 m/s) of the VR. The application of the axial stream 5 and the impinging stream 6 is started within the critical value t1C(=1.1 s) of the time after the entire steel pipe 1 is dipped 4, and continued until the temperature of the steel pipe 1 is decreased to be equal to or lower than the critical value T1C(=150° C.) of the temperature. The pipe flow velocity VL of the axial stream 5 is set to be equal to or more than the critical value VLC(=7 m/s) of the VL, and the discharge flow velocity VT of the impinging stream 6 is set to be equal to or more than the critical value VTC(=9 m/s) of the VT.

When the circumferential velocity of pipe VR in the rotation 2 is less than the VCR (4 m/s), plastic strain due to the difference in cooling history at a position in the circumferential direction of pipe and the difference in transformation behavior associated therewith increases, resulting in deformation of the steel pipe. Hence, VR VRC (4 m/s). Furthermore, this also promotes separation of gas bubbles from the inside and outer surfaces of the pipe during quenching and is thus effective in increasing the heat-transfer coefficient.

Preferably, the circumferential velocity of pipe VR is 5 m/s or more. Note that the upper limit of VR is 8 m/s or less because of a concern that the steel pipe may run out owing to eccentricity.

When the time t1 from the dipping 4 of the entire steel pipe 1 until the start of application of the axial stream 5 and the impinging stream 6 exceeds the t1C (1.1 s), gas bubbles generated, in particular, on the inside surface of the pipe spread into a more stable water vapor film, and the water vapor film adheres to the inside surface of the pipe. The adhering water vapor film is unlikely to be separated from the inside surface of the pipe even by application of the axial stream 7, and the cooling capacity does not improve. Hence, t1≤t1C (1.1 s). Preferably, t1 is 0.9 s or less.

When the temperature T1 of the steel pipe at the time of stopping the application of the axial stream 5 and the impinging stream 6 exceeds the T1C (150° C.), quenching and hardening is unlikely to proceed sufficiently to the deep portion in the wall thickness direction. Hence, T1≤TIC (150° C.) Note that T1 is the value measured when the steel pipe 1 is held in water for about 10 seconds after stopping the axial stream 5 and the impinging stream 6, elevated into air, and further held for about 10 seconds. Preferably, T1 is 100° C. or lower. Note that the lower limit of T1 is 50° C. for the reason that as the temperature is decreased, a longer cooling time is required, resulting in a decrease in productivity.

When the pipe flow velocity VL of the axial stream 5 is less than the VLC (7 m/s), gas bubbles generated on the inside surface of the pipe are unlikely to be removed, and the cooling power at the inside surface of the pipe does not improve. Hence, VL≥VLC (7 m/s).

Preferably, the pipe flow velocity VL is 10 m/s or more. Note that the upper limit of VL is 20 m/s in view of equipment cost.

When the discharge flow velocity VT of the impinging stream 6 is less than the VTC (9 m/s), gas bubbles generated on the outer surface of the pipe are unlikely to be removed, and the cooling power at the outer surface of the pipe does not improve. Hence, VT≥VTC (9 m/s).

Preferably, the discharge flow velocity VT of the impinging stream 6 is 12 m/s or more. Note that the upper limit of VT is 30 m/s in view of equipment cost.

Regarding the steel composition of a steel pipe to which disclosed methods are to be applied, even when a predetermined target strength can be stably obtained in the case of a thin wall (wall thickness: less than ½ inch) even if the disclosed cooling condition specified herein is not satisfied, but the predetermined target strength is not stably obtained by the conventional cooling method in the case of a heavy wall (wall thickness: ½ inch or more, preferably 2 inch or less), the predetermined target strength can be stably obtained by disclosed methods. Examples of such a steel composition include the composition A described above.

EXAMPLES

Seamless steel pipes having the chemical composition (units of measure: massa, the balance being Fe and incidental impurities) and the size (wall thickness t×outside diameter D×length L) shown in Table 1 were subjected to quenching and tempering (Q-T) treatment only once. The cooling step in the Q treatment was carried out in the same manner as that of the cooling step of the example shown in FIG. 1. The tempering (T) treatment was carried out under the normal tempering conditions (i.e., after the steel pipe was heated to the normal tempering temperature inside of furnace, it was left to stand to cool outside the furnace). The conditions for the Q-T treatment are shown in Table 2.

Tensile strength (abbreviated as TS) and hardness of the surface part and central portion in the wall thickness direction were measured on the steel pipes subjected to the Q-T treatment.

The measurement results are shown in Table 2. As is evident from Table 2, in comparison with comparative examples, in the examples according to embodiments, the TS at the center of the wall thickness direction reaches the target strength of 95 to 140 ksi (=655 to 965 MPa). In addition, it is recognized that the difference in hardness between the surface part and the central portion decreases (the surface/center hardness ratio falls in a range of 1.00 to 1.05), and homogeneous materials can be obtained.

TABLE 1

| Steel | Chemical composition (mass %) | | | | | | | | | | | | | | | Pipe size | | |
|---|---|---|---|---|---|---|---|---|---|---|---|---|---|---|---|---|---|---|
| pipe | C | Si | Mn | P | S | Al | Cr | Mo | Nb | V | Cu | Ni | Ti | B | N | t(mm) | D(mm) | L(m) |
| A0 | 0.04 | 0.098 | 1.90 | 0.008 | — | 0.025 | — | 0.23 | 0.014 | 0.040 | — | 0.49 | 0.009 | — | 0.0039 | 25.4 | 139.7 | 10.3 |
| A1 | 0.30 | 0.75 | 0.68 | 0.007 | 0.002 | 0.025 | 1.18 | 0.72 | 0.035 | 0.054 | 0.32 | 0.18 | 0.020 | 0.0020 | 0.0070 | 38.4 | 244.5 | 10.3 |

TABLE 2

| | | Q treatment | | | | | | T treatment | | | | |
|---|---|---|---|---|---|---|---|---|---|---|---|---|
| | | Heating | | | | | | Heating | Material properties | | | |
| Condition No. | Steel pipe | temperature (° C.) | VR (m/s) | t1 (s) | T1 (° C.) | VL (m/s) | VT (m/s) | temperature (° C.) | TS (MPa) | Surface/center hardness ratio | Others | Remarks |
| 1 | A0 | 900 | 3.1 | 1.0 | 173 | 7.1 | 9.3 | 600 | 610 | 1.18 | Bending occurred | Comparative example |
| 2 | A0 | 900 | 4.2 | 1.0 | 146 | 7.2 | 9.2 | 600 | 690 | 1.05 | | Example ~~of present invention~~ |
| 3 | A0 | 900 | 4.2 | 1.3 | 142 | 7.2 | 9.1 | 600 | 686 | 1.06 | Bending occurred | Comparative example |
| 4 | A0 | 900 | 4.1 | 1.1 | 142 | 6.4 | 9.1 | 600 | 641 | 1.11 | | Comparative example |
| 5 | A0 | 900 | 4.3 | 1.1 | 140 | 7.2 | 8.4 | 600 | 624 | 1.10 | | Comparative example |
| 6 | A1 | 920 | 4.3 | 1.0 | 131 | 7.3 | 9.4 | 685 | 871 | 1.04 | | Example ~~of present invention~~ |
| 7 | A1 | 920 | 4.1 | 1.1 | 212 | 7.1 | 9.2 | 685 | 800 | 1.13 | | Comparative example |
| 8 | A1 | 920 | 4.1 | 1.1 | 146 | 7.1 | 7.8 | 685 | 809 | 1.11 | | Comparative example |
| 9 | A1 | 920 | 4.2 | 1.2 | 140 | 6.2 | 9.3 | 685 | 821 | 1.10 | | Comparative example |
| 10 | A1 | 920 | 4.1 | 1.1 | 141 | 7.2 | 9.2 | 685 | 865 | 1.05 | | Example ~~of present invention~~ |
| 11 | A1 | 920 | 3.1 | 1.1 | 141 | 7.2 | 9.2 | 685 | 836 | 1.10 | | Comparative example |

REFERENCE SIGNS LIST

1 steel pipe
2 rotation
3 water (cooling medium)
4 dipping
5 axial stream
6 impinging stream
10 roller
11, 12 nozzle

The invention claimed is:

1. A method for manufacturing a heavy wall steel pipe, the method comprising:

dipping a steel pipe having a wall thickness of ½ inch or more in water, the steel pipe having been heated to a gamma range, the dipping including supporting and rotating the steel pipe about an axis of the steel pipe at a circumferential velocity of pipe of 4 m/s or more;

applying an axial stream comprising a water flow in a direction of the axis of the steel pipe to an inside surface of the steel pipe under rotation in the water, a pipe flow velocity of the axial stream being 7 m/s or more; and applying an impinging stream comprising a water flow in a direction of a diameter of the steel pipe impinging on an outer surface of the steel pipe under rotation in the water, a discharge flow velocity of the impinging stream being 9 m/s or more, wherein the application of each of the axial stream and the impinging stream are started within 1.1 s after the entire steel pipe is dipped in the water and continued until the temperature of the steel pipe is decreased to 150° C. or lower, and the direction of the diameter of the steel pipe is perpendicular to the direction of the axis of the steel pipe.

2. The method for manufacturing a heavy wall steel pipe according to claim 1, wherein the wall thickness is in a range of ½ inch to 2 inches.

3. The method for manufacturing a heavy wall steel pipe according to claim 1, wherein a temperature of the dipping water is in a range of 50° C. or less.

4. The method for manufacturing a heavy wall steel pipe according to claim 1, wherein during the dipping step a heat-transfer coefficient at the inside surface and the outer surface of the steel pipe is within a range of 7,500 to 8,000 $kcal/m^2 \cdot h \cdot ^\circ C$.

5. The method for manufacturing a heavy wall steel pipe according to claim 1, wherein a tensile strength at a center of the steel pipe in the wall thickness direction is in a range of 95 to 140 ksi.

6. The method for manufacturing a heavy wall steel pipe according to claim 1, wherein a ratio of a hardness of the outer surface and a center of the heavy wall steel pipe is in a range of 1.00 to 1.05.

7. The method for manufacturing a heavy wall steel pipe according to claim 1, wherein the application of each of the axial stream and the impinging stream are started within 0.9 s after the entire steel pipe is dipped in the water.

8. The method for manufacturing a heavy wall steel pipe according to claim 1, wherein the axial stream is applied from at least a first nozzle oriented in the direction of the axis of the steel pipe, and the impinging stream is applied from at least a second nozzle oriented in the direction of the diameter of the steel pipe.

* * * * *